US012104347B2

(12) United States Patent
Miller et al.

(10) Patent No.: US 12,104,347 B2
(45) Date of Patent: Oct. 1, 2024

(54) COUPLER

(71) Applicant: Miller UK Limited, Cramlington Northumberland (GB)

(72) Inventors: Keith Miller, Cramlington (GB); Gary Miller, Cramlington (GB); Gavin Urwin, Cramlington (GB); Chris Bradley, Cramlington (GB); Chris Lewis, Cramlington (GB); Howard Reay, Cramlington (GB)

(73) Assignee: Miller UK Limited, Northumberland (GB)

( * ) Notice: Subject to any disclaimer, the term of this patent is extended or adjusted under 35 U.S.C. 154(b) by 756 days.

(21) Appl. No.: 17/254,443

(22) PCT Filed: Jun. 21, 2019

(86) PCT No.: PCT/GB2019/051751
§ 371 (c)(1),
(2) Date: Dec. 21, 2020

(87) PCT Pub. No.: WO2020/002885
PCT Pub. Date: Jan. 2, 2020

(65) Prior Publication Data

US 2021/0222392 A1 Jul. 22, 2021

(30) Foreign Application Priority Data

Jun. 25, 2018 (GB) ..... 1810411

(51) Int. Cl.
*E02F 3/36* (2006.01)

(52) U.S. Cl.
CPC ..... *E02F 3/3618* (2013.01); *E02F 3/3622* (2013.01); *E02F 3/365* (2013.01); *E02F 3/3663* (2013.01)

(58) Field of Classification Search
CPC ..... E02F 3/3618; E02F 3/3622; E02F 3/365; E02F 3/3663
See application file for complete search history.

(56) References Cited

U.S. PATENT DOCUMENTS 2,712,742 A * 7/1955 Neidhart ..... F16F 1/545 464/83
3,783,639 A * 1/1974 Goodman ..... F16D 3/12 464/83

(Continued)

FOREIGN PATENT DOCUMENTS

AU 2008/275755 B9 12/2014
CN 101688381 A 3/2010

(Continued)

OTHER PUBLICATIONS

International Search Report PCT/ISA/210 for International Application No. PCT/GB2019/051751 dated Oct. 7, 2019.

(Continued)

*Primary Examiner* — Jamie L McGowan
(74) *Attorney, Agent, or Firm* — Harness, Dickey & Pierce, P.L.C.

(57) ABSTRACT

An excavator coupler including a front jaw for receiving a first attachment pin of an accessory and a rear pin receiving area for receiving a second attachment pin of the accessory, a first closure mechanism for the rear pin receiving area, the first closure mechanism including an actuator and a movable second pin engaging surface for selectively securing the second attachment pin in the rear pin receiving area and for pulling the first attachment pin into the front jaw of the coupler, a second closure member for the front jaw for selectively retaining the front attachment pin in the front jaw, and a front latch control component for selectively controlling the second closure member between an open state and a closed state wherein the actuator includes a (Continued)

release member for selectively engaging a release arm on the front latch control component to activate or deactivate the front latch control component.

17 Claims, 5 Drawing Sheets

(56) References Cited

U.S. PATENT DOCUMENTS

| | | | | |
|---|---|---|---|---|
| 3,952,365 | A * | 4/1976 | Grisebach | E05F 1/1238 16/85 |
| 5,591,083 | A * | 1/1997 | Kirschey | F16D 3/68 464/83 |
| 6,125,559 | A * | 10/2000 | Mullenhour | E01H 5/062 37/232 |
| 6,219,943 | B1 * | 4/2001 | Kitchell | E01H 5/063 37/232 |
| 6,354,025 | B1 * | 3/2002 | Kirchell | E01H 5/063 37/232 |
| 7,195,307 | B2 * | 3/2007 | Tucker | B62D 25/10 296/193.11 |
| 8,403,590 | B2 * | 3/2013 | Hill | E02F 3/3663 37/468 |
| 9,408,339 | B2 * | 8/2016 | Jensen | A01B 27/005 |
| 9,469,965 | B2 * | 10/2016 | Hill | E02F 3/365 |
| 2008/0193210 | A1 * | 8/2008 | Beales | E02F 3/3618 403/326 |
| 2009/0282712 | A1 * | 11/2009 | Pruszynski | E02F 3/365 37/468 |
| 2011/0209608 | A1 * | 9/2011 | Stefek | E02F 3/3622 91/468 |
| 2011/0227309 | A1 * | 9/2011 | Arulraja | E02F 9/024 280/124.116 |
| 2013/0318841 | A1 | 12/2013 | Robl et al. | |
| 2014/0159294 | A1 | 6/2014 | George | |
| 2016/0002877 | A1 | 1/2016 | Pesch et al. | |
| 2017/0067223 | A1 | 3/2017 | Tsukada et al. | |

FOREIGN PATENT DOCUMENTS

| | | | |
|---|---|---|---|
| CN | 102667005 | A | 9/2012 |
| CN | 104234099 | A | 12/2014 |
| EP | 2161378 | A1 | 3/2010 |
| EP | 3249106 | A1 | 11/2017 |
| FR | 3007049 | A1 | 12/2014 |
| GB | 2473942 | A | 3/2011 |
| GB | 2479221 | A | 10/2011 |
| GB | 2492850 | A | 1/2013 |
| IT | VR20110041 | A1 | 9/2012 |
| JP | S62-157708 | A | 7/1987 |
| JP | 2009-091107 | A | 4/2009 |
| JP | 2016-166509 | A | 9/2016 |
| JP | 2017-198345 | A | 11/2017 |
| KR | 10-2009-0056125 | A | 6/2009 |
| KR | 20140143071 | A | 12/2014 |
| WO | WO-2008/031590 | A2 | 3/2008 |
| WO | WO-2008/138932 | A2 | 11/2008 |
| WO | WO-2014/092584 | A1 | 6/2014 |
| WO | WO-2017/079792 | A1 | 5/2017 |
| WO | WO-2018/056841 | A1 | 3/2018 |

OTHER PUBLICATIONS

Written Opinion of the International Searching Authority PCT/ISA/237 for International Application No. PCT/GB2019/051751 dated Oct. 7, 2019.
Search Report for Intellectual Property Office application No. GB1810411.7 dated Dec. 9, 2019.
International Report on Patentability and Written Opinion for PCT/GB2019/051751 dated Jan. 7, 2021.
Office Action for European Application No. 19 734 481.5 dated Feb. 22, 2023.
Search Report for Great Britain Application No. 2218225.7 dated Dec. 14, 2022.
Search Report for Great Britain Application No. 2218224.0 dated Dec. 15, 2022.
Search Report for Great Britain Application No. 2218226.5 dated Dec. 14, 2022.
Examination Report dated Aug. 23, 2022, issued in corresponding United Kingdom Patent Application No. GB1810411.7.
Examination Report dated Jul. 25, 2022, issued in corresponding Indian Patent Application No. 202117002741.
Office Action dated Jan. 13, 2022, issued in corresponding Chinese Patent Application No. 201980043190.6.
Intention to Grant dated Nov. 3, 2022, issued in corresponding United Kingdom Patent Application No. GB1810411.7.
Examination Report dated Mar. 29, 2022, issued in corresponding United Kingdom Patent Application No. GB1810411.7.
Office Action dated Apr. 28, 2023 issued in corresponding Japanese Patent Application No. 2020-572924.

* cited by examiner

COUPLER

CROSS-REFERENCE TO RELATED APPLICATIONS

This application is a national phase under 35 U.S.C. § 371 of PCT International Application No. PCT/GB2019/051751 which has an International filing date of Jun. 21, 2019, which claims priority to United Kingdom Application No. 1810411.7, filed Jun. 25, 2018, the entire contents of each of which are hereby incorporated by reference.

The present invention relates to a coupler for coupling an accessory to an excavator arm of an excavator. One such accessory could be an excavator bucket.

Couplers, also known as quick couplers, quick hitches or excavator couplers, for coupling accessories to the excavator arm of an excavator are well known in the art. The couplers generally comprise a top half that is connectable to an excavator arm using two attachment pins (via two pairs of holes provided for those attachment pins) and a bottom half for engaging two further attachment pins, on the accessory. In modern couplers, the bottom half typically comprises two jaws, rather than holes. Those jaws engage respective ones of those two further attachment pins of the accessory, and a closure mechanism for at least one of those jaws is provide, usually driven by a remote operable actuator, such as a screw-drive, or a hydraulic cylinder, operable from the cab of the excavator.

A common feature of many such couplers is that one of the two jaws is usually referred to as a front jaw. Its opening (for receiving a first or front one of the two attachment pins of the accessory) is generally directed out of a first end of the coupler. This first end is commonly referred to as the front end as it is the end that is guided first onto an accessory pin. The direction that the opening faces—the forward direction—lies generally parallel to an imaginary line joining the two pairs of holes in the top half of the coupler, as used for attachment of the coupler to the end of the excavator arm. Sometimes the direction that the opening faces is angled slightly upwards from that line, perhaps by up to an angle of up to 15° from parallel, but often it is nearly directly parallel to that line.

The second jaw is then usually referred to as a rear jaw, as it lies nearer the opposite, or back end of the coupler, albeit in the bottom wall of the coupler. It generally opens downwardly, i.e. in a direction that is generally perpendicular to the front jaw, or the imaginary line between the two pairs of holes in the top half of the coupler. It also may be off that perpendicular, perhaps by up to 15°.

The jaws from the side of the coupler appear singular, but often the jaws are bifurcated—especially the rear jaw, as there are working mechanisms inside the coupler, and they often need to be serviceable. Commonly they are formed integrally to the body of the coupler, although they can be made of harder steel than the main body of the coupler, and joined thereto during the production of the coupler.

For the purpose of this application we refer to the rear jaw and the front jaw, even though each jaw may have more than one element.

The rear jaw commonly has a closure mechanism comprising a closure member and an actuator. For most couplers the closure member is described as a hook or a closure plate. The closure member can be slid or pivoted between a latched position and an unlatched position by using the actuator. In the latched position, the opening of rear jaw is at least partially closed by the closure member. In the unlatched position, the closure member is retracted out of the latching position so as to leave the jaw's opening as open as needed to allow the second attachment of the accessory to be located therein. This may be a full retraction to completely clear the opening of the rear jaw, or a less complete retraction wherein the opening of the jaw is only partially obscured, but less than in the extent needed for latching position for a particular accessory (different accessories may have different pin spacing, so often there is a degree of variance in the latching position during use of a coupler.

The unlatched position is both for allowing upward insertion of the second attachment pin in the rear jaw, and for allowing a previously captured attachment pin to be removed from the jaw downwardly.

The insertion or removal of the second attachment pin is usually achieved by rotating the coupler to drop or lift the rear jaw relative to the front jaw. During this process, it is best if the accessory has previously be laid on the ground so that it cannot drop off the coupler.

As indicated before, sometimes it is enough just to retract the closure member out of the way of the attachment pin, rather than all the way out of the jaw.

Secondary locking devices are also often provided for these couplers. For example, the coupler in GB2330570 also features a blocking bar which is adapted to fall under the influence of gravity into a blocking position in front of the closure member—in that case a pivoting latching hook. In that blocking position, the blocking bar will resist the unlatching of the latching hook, even in response to operation of the hydraulic ram as provided for that purpose, by blocking the hook's path from its latching position into an unlatched position. The blocking bar achieves that position when the coupler is in a normal, in-use, orientation of the coupler, i.e. most non-inverted orientations.

The blocking bar is pivotally mounted about a pivot. That pivot is positioned near the front jaw. The blocking bar therefore points generally towards the rear jaw from that pivot and is balanced about that pivot such that gravity will usually urge it towards its blocking position, i.e. while the coupler is in the normal, in-use, orientation rather than upside down or partially inverted. Then, in order to unblock the latching hook (for decoupling the accessory from the coupler), either the coupler would need to be inverted or else some form of urging means would be provided for lifting the blocking bar from its blocking position into a non-blocking position. One such urging means could be a small hydraulic ram.

Due to the configuration of the elements of the various moveable components in these couplers, the latching and unlatching actions, for attaching or detaching an accessory to the coupler (on the end of an arm of an excavator), typically have to be performed using a series of predefined steps, upon which the design of the mechanisms enable cooperation with each other for the latching or unlatching processes. This is important so as to prevent inadvertent detachment, or to ensure appropriate attachment—an incorrect attachment can result in an unexpected detachment, or damage to the components of the coupler. What would be desirable, however, would be to provide a coupler, or a system involving a coupler, in which both jaws are able to secure a respective pin, but in which a more simple or fool proof set of predefined steps can be employed for the attachment and detachment procedures, but while still maintaining a safe securement and retention of an accessory, a safe detachment process, and even a safe attachment in the event of a "pin miss" on either the front jaw or a rear jaw.

According to a first aspect of the present invention there is provided an excavator coupler comprising:

a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory;

the coupler further comprising:

a first closure mechanism for the rear pin receiving area, the first closure mechanism comprising an actuator and a movable second pin engaging surface for securing the second attachment pin in the rear pin receiving area and for pulling the first attachment pin into the front jaw of the coupler;

a second closure member for the front jaw for selectively retaining the front attachment pin in the front jaw; and a front latch control component for selectively controlling the second closure member in either an open configuration or a closed configuration;

wherein the actuator comprises a release member extending toward the front of the coupler for selectively engaging a release arm on the front latch control component to activate or deactivate the front latch control component.

Preferably the rear pin receiving area is a rear jaw that is open to a bottom of the coupler.

Preferably a bottom wall of the front jaw comprises a lip at its free end.

Preferably the rear pin receiving area comprises a lip at its free end.

Either or both of the lips can assist in the prevention of release of a respective first or second attachment pin from the respective jaw or pin receiving area.

The lip preferably defines an upwardly angled slope that will resist the exit of a pin from the grasp thereof.

Preferably the rear pin receiving area comprises an angled slope leading towards the free end thereof to force the second attachment pin into engagement with the rear pin receiving area when the two pins are clamped onto the coupler by the actuator.

Preferably the angled slope is combined with the lip to define a depression, or they are spaced apart enough to define a recess, into which the second attachment pin of the accessory can rest in the event of a retraction of the first closure member, out of which the accessory pin would need to lift in order to clear the lip.

Preferably the actuator is a hydraulic ram with a cylinder and piston.

Preferably the movable second pin engaging surface is part of a latch. Preferably the latch is a pivoting hook. It might be a sliding plate or jaw.

Preferably the cylinder is attached to the latch and the free end of the piston is attached to the housing of the coupler. Alternatively the free end of the piston is attached to the latch and the cylinder is attached to the housing.

Other forms of actuator, such as pneumatic or screw-drive actuators, can instead be used.

Preferably the latching hook pivots within the coupler housing around an axle.

Preferably the second closure member is pivotally mounted to the housing about a second axle. Preferably the second axle is positioned above and in front of a back wall of the front jaw. Preferably it lies in front of the attachment pin when the attachment pin is seating against the back of the front jaw.

Preferably the second closure member is sprung into a default latching position.

The second closure member has a range of motion either side of the default latching position. The range is between a more closed condition and an open condition.

Preferably the release arm can selectively move the second closure member to the open condition, or release it to the default position.

Preferably the first attachment pin, if allowed to hang on the second closure member, can move it to the more closed position.

Preferably the more closed position is such that a latching bar of the second closure member points to the lip of the front jaw.

The more closed condition is such that a release surface of the second closure member moves into a position beyond the reach of the release arm, whereby the release arm cannot open the second closure member until the second closure member reverts to the default latching position, or a position between that and the open condition.

Preferably when the second closure member is in the more closed condition, the release arm is located above the second closure member when fully engaged by the release member, in which position the release arm prevents opening of the second closure member.

Preferably the second closure member is biased into its default latching position by a bi-directional spring to allow the bi-directional movements of the second closure member—to either the more latched condition or the open condition.

Preferably the spring is a Rosta-type spring with an inner bar, an outer casing, each with square sections, and elastic members in the corners of the outer casing. However a conventional coil spring could likewise operate to serve that purpose.

Preferably the Rosta-type spring is such that the axle of the second closure member is rotationally fixed relative to the latching bar of the second closure member, and it forms the inner bar of the Rosta-type spring, the outer casing being rotationally fixed relative to the housing of the coupler.

Alternatively the Rosta-type spring is such that the outer casing of the Rosta-type spring is rotationally fixed relative to the latching bar of the second closure member, and the axle is rotationally fixed relative to the housing of the coupler.

Preferably the outer casing is a single piece construction.

Preferably the Rosta-spring provides approximately a 60° angle of rotation between the maximum one way and the maximum the other way.

The second closure member may have flanges or surfaces thereon which interact with stop surfaces 46 on the coupler housing 88 to restrict rotational movement of this second closure member 74 so that it will allow degrees of rotation of perhaps no more than 40 to 90°. In this embodiment it is about 60° between fully blocking and fully open. This prevents over turning of the Rosta-type spring or over stretching of a conventional spring if instead provided.

Preferably the fully open condition for the second closure member brings the lowest edge of the second closure member substantially parallel to, and preferably flush with or higher than, the upper wall 42 of the front jaw.

Preferably that edge rotates down to a condition in the more closed condition that defines an angle with the upper wall of 60 degrees. Preferably it is 30 degrees in the default latching position. However, it may be a chosen angle between 20° and 50° from the fully open position.

Instead of 30°, other angles are possible, dependent upon the amount of tortion desired to open the jaw—the deformable members provide additional resistance to torque, the more the inside rotates relative to the outside.

As for the more closed position, this might be between 30 and 80 degrees from the fully open position.

Preferably the second closure member is provided with a curved free end surface, which surface will be engaged by the first attachment pin if the first attachment pin is free to lift off the back of the front jaw into contact with the second closure member. That curved surface can serve to partially cup the attachment pin.

In the bottom wall of the front jaw there is preferably a recess for accommodating a part of the attachment pin if allowed to lift from the back of the front jaw.

Preferably the latching bar of the second closure member extends generally radially from the pivot axis thereof.

Preferably the release surface engaged by the release arm is provided on a flange of the second closure member that preferably extends substantially radially from the pivot axis of the second closure member.

Preferably a groove or recess is provided between the latching bar and the flange.

Preferably the release arm's free end is sized to loosely fit in the groove or recess to access the release surface of the flange.

Preferably the release arm clears the flange when the second closure member is in a more closed condition to access a reverse side of the flange when the second closure member is attempted to be returned to the open condition.

Preferably the front latch control component has a second arm, located behind the release member, which second arm will bear against the release member when the release arm is engaged by the reverse side of the flange, preventing lifting of the second closure member into the open condition.

Preferably the release member has a protrusion on a side thereof, which protrusion has a forward face that contacts the release arm.

It also has a rear face that contacts the second arm to prevent lifting of the second closure member into the open condition if the release arm is above the reverse side of the flange. Using a side protrusion allows the release arm to be spaced to the side of the cylinder 40, as the protrusion extends sideways too.

Preferably the front latch control component is a pivotal component, which preferably is mounted on the same axis or axle as the piston, i.e. on the piston pin. Preferably the release arm, and the second arm, extend radially outward from the axis of that pivotal component.

The present invention also provides an excavator coupler comprising:

- a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory;
- a first closure member for the rear pin receiving area, the first closure member comprising an actuator for moving the first closure member between a latching state a release state; and
- a second closure member for the front jaw, the second closure member comprising a hub that is mounted for axial rotation about its axis, the hub having a Rosta-type spring to centre it in a default locking position in which a locking arm of the second closure member at least partially extends across a mouth of the front jaw.

Preferably the hub is provided as a tube or barrel onto which the additional parts are formed, moulded or mounted. The hub, tube or barrel of the second closure member can be pivotally mounted onto the frame by an axle pin—preferably the central component of the Rosta-type spring.

This second aspect may also include the features of the first aspect of the invention.

The Rosta type spring preferably comprises a pin with a square section along at least a part of its length, which square section is mounted within a larger square tube or formation with a variable relative angle of rotation, but by default a relative angle of rotation of about 45°, with elastically deformable members provided in the four corners of the larger square, against outer surfaces of the inner square. The elastically deformable members bear against the outside faces of the square section of the pin and the inside corners of the larger square section, whereby the pin and larger square sections can rotate relative to one another by compressing and shearing the deformable members, the resulting return bias serving to return the two square members to the default 45° arrangement.

The outer square may be formed by a square section component or by mounting three square sides onto a flat surface.

For alternative arrangements, a triangular section, or a polygonal section of more than 4 sides may be used instead. However, four sides is found to be the most effective solution for a second closure member having a desired degree of rotation of about 60 degrees—30 degrees either way from the default position.

Preferably the axis of the pin is fixed relative to the coupler housing.

Preferably the upper wall of the rear pin receiving area is convexly curved about a central part thereof, as viewed from the side of the coupler, with the first closure member being a pivotal latching member. Preferably with the radial centre of the convex curve falls at the hinge axis of the pivotal latching member.

Preferably the front jaw has a recess in its bottom surface with a lip at the free end thereof, whereby the first attachment pin of the accessory, when in that jaw, can descend into the recess and would thereafter need to rise out of it in order to exit over the lip.

An issue that can arise with the coupler is a failure of the hydraulics. Generally this simply results in a lock-out of the coupler as there are generally provided no-return valves in the hydraulics system of the actuator. Nevertheless, there can be situations where the pressure would drop in the hydraulics allowing the piston to retract into the cylinder unintentionally, such as if the cylinder casing was to be cracked. In that situation, if the coupler was appropriately oriented, the weight of the accessory could theoretically draw the two attachment pins forwards, thus lifting the front attachment pin forwards from the back of the front jaw. If unnoticed, and the piston was to be retracted further into the cylinder, the latching hook could ultimately release the rear attachment pin, thus creating the situation of FIG. 3. Although in this situation the accessory is still secured onto the coupler by the front jaw, whereby it won't fall off the coupler, there is still a desire to create a back-up for the hydraulics to prevent or resist that accidental contraction of the piston into the cylinder.

According to a third aspect of the present invention there is provided an excavator coupler comprising:

a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory; and a first closure member for the rear pin receiving area, the first closure member comprising an actuator for moving the first closure member between a latching state a release state;

wherein:

the actuator is a hydraulic actuator with a cylinder and a piston; and a sprung driver is provided internal of the piston to bias the piston to its extended condition relative to the cylinder.

Preferably the sprung driver is a pneumatic piston.

Preferably the sprung driver comprises a casing mounted within the piston, and a rod extending from the casing and into the void of the cylinder beyond the piston.

Preferably the cylinder has a head at the proximal end of the cylinder, with the piston extending out of the distal end of the cylinder. Preferably the rod is attached to the head, or the end wall of the cylinder at the proximal end of the cylinder.

Preferably a protective sleeve surrounds the rod. Preferably the sleeve has an open end sized to accommodate the casing.

A seal is provided between the rod and the casing so that as the rod presses into the casing, an internal pressure builds in the casing, providing a return force against the rod into the extended state.

Preferably a seal is provided between the casing and the end of the piston, or the inside wall of the bore into which the piston is located.

Alternatively a seal is provided between the inside wall of the bore into which the piston is located and the protective sleeve.

Preferably a further seal is provided between the protective sleeve and the casing when the casing's end nearest the proximal end of the cylinder is located in the protective sleeve.

In an alternative embodiment, the casing is formed as part of the piston, the rod extending from the proximal end of the piston, and being sealed against the inside wall of the bore into which the rod is located, whereby the void distal of the rod, in the piston, provides the compressive return force on the rod after the rod is pushed into the piston.

In an alternative embodiment, the casing's proximal end is attached to the head of proximal end wall of the cylinder and the rod extends out of the distal end of the casing and into a bore in the piston, the free end of the rod preferably being attached to the piston, preferably at the end of the rod.

Preferably the distal end of the piston also locates into the bore in the piston, the bore being larger than the diameter of the rod. A seal can be provided on the inside wall of the bore into which the piston is located, or at the entrance thereto.

The seals serve to prevent the hydraulic fluid that drives the piston from getting into the bore in the piston, and into the casing.

Where the sprung driver is a pneumatic piston, the seals also prevent the air or gas of the pneumatic piston, and within the bore around the rod or casing, or in the protective sleeve around the rod/casing, from getting into the hydraulic fluid of the cylinder.

In an alternative embodiment, the sprung driver is mounted to a side of the cylinder, preferably in a moulding connected to the wall of the cylinder.

Preferably the side is the underside of the cylinder.

A protective sleeve may again be provided to protect the rod—as the rod is relatively thin, the protective sleeve widens the radius of the moving part, thus resisting buckling of the sprung driver.

In this alternative embodiment, it is preferred that the free end of the sprung driver is pivotally attached to a flange at its distal end, the proximal end being within the moulding.

The compressed gas of a pneumatic piston may be contained both within the casing, and out an end of the casing, the object to which the casing is attached providing an extension of the gas cavity. This allows a shorter casing to be used.

Preferably the gas cavity is connected to a feed line, which allows selective repressurisation of the gas cavity. This makes the product a serviceable component, whereby any loss of pressure after a period of use can be corrected.

These and other features of the present invention will now be described in further detail, purely by way of example, with reference to the accompanying drawings in which:

FIG. 1 schematically shows internal workings of an example of a coupler in accordance with the present invention in an accessory latching condition, with two attachment pins of an accessory secured within the two jaws of the coupler;

FIG. 2 schematically shows internal workings of the coupler of FIG. 1 in an accessory release condition, with a first attachment pin of the accessory in, but free to be removed from, the front jaw of the coupler, and the second attachment pin ready to be moved into, or having been removed from, the rear jaw of the coupler;

FIG. 3 schematically shows internal workings of the coupler of FIG. 1 in an improper release condition, with a first attachment pin of the accessory locked within the front jaw of the coupler, and the second attachment pin ready to be moved into, or having been removed from, the rear jaw of the coupler;

Figure 1:
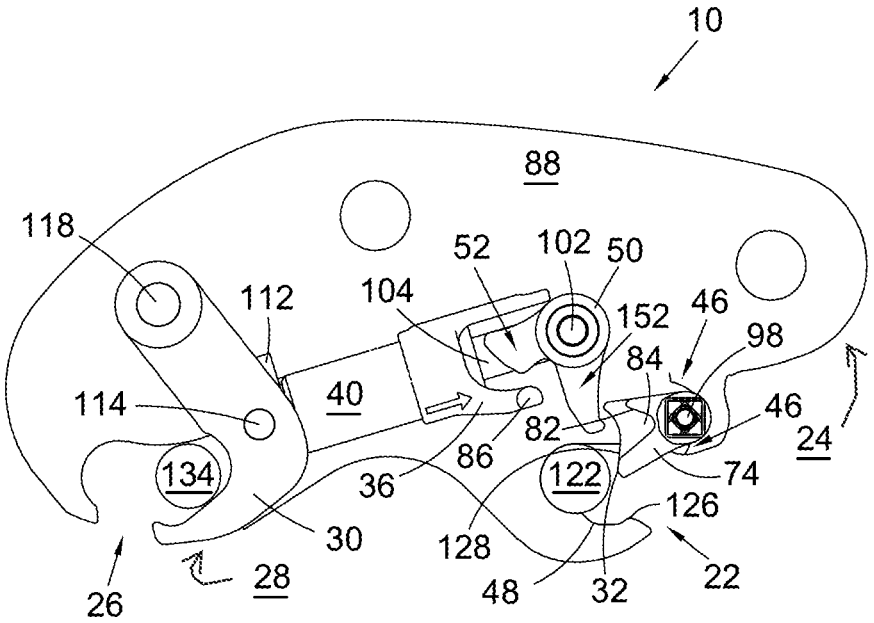

Referring first of all to FIG. 1, there is shown a schematic view of a coupler 10 in accordance with the present invention. The coupler 10 comprises a main housing 88 having a top part 12 and a bottom part 18. In this preferred style of coupler, the top part has a pair of attachment holes 44 for attaching the coupler 10 to an excavator arm of an excavator, as is well known in the art.

The bottom part 18 instead has two jaws 22, 26 with a first jaw 22 being positioned to be open to the front 24 of the coupler whereas the second jaw 26 is open to the bottom 28 of the coupler 10. The second jaw is commonly referred to as the horseshoe, although it can have different shapes, including a narrower opening, a wider opening or a single side—for a more variable accessory capacity, as this is a rear pin receiving area and a rear attachment pin 134 may be at a wider or narrower spacing from a front attachment pin 122 of the accessory, dependent upon the size or manufacturer of the accessory. Any given accessory, however, will generally have a fixed pin spacing, whereby a coupler can be sized to accommodate a range of accessory sizes, or just a few accessories of a given pin arrangement, if the rear jaw is narrower.

The illustrated rear jaw 26 is wider than it is deep, to offer a wide range of accessory compatibilities, whereas the first or front jaw 22 is deeper than it is wide to offer a deeper securement of the first attachment pin 122 therein.

As illustrated, the rear jaw is preferred to be at least 2× the depth (i.e. height) of the jaw 26 at its deepest part.

The coupler 10 also includes a first closure member 30, a second closure member 74 and a hydraulic ram or cylinder 40. The hydraulic ram or cylinder 40 is commonly referred to as the actuator. Other forms of actuator, such as pneumatic or screw-drive actuators, can instead be used.

Figure 2:
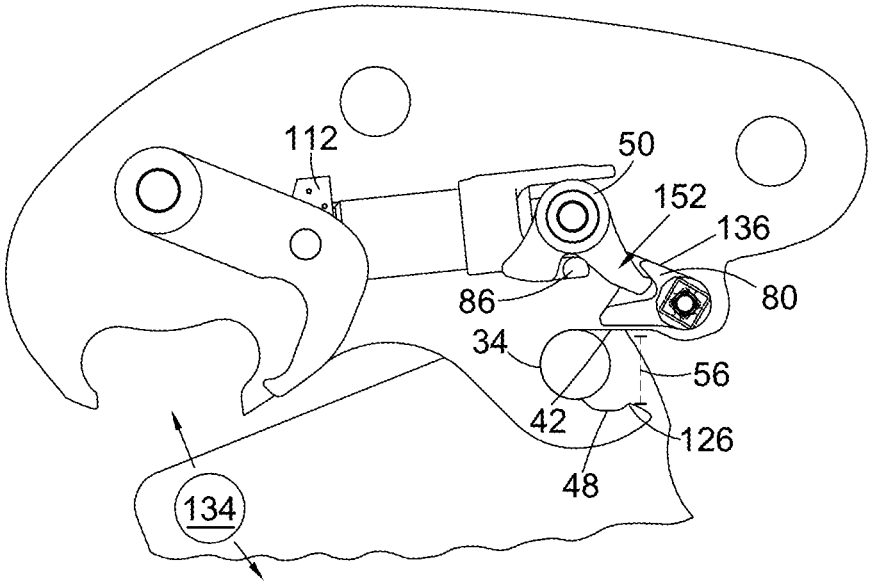
Figure 3:
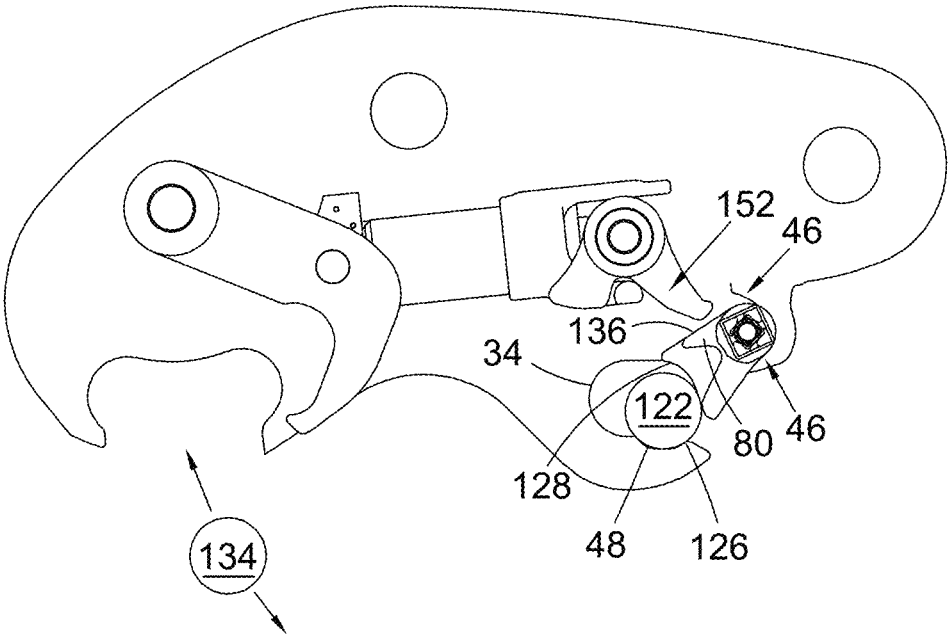

The first closure member 30 is for latching the second attachment pin 134 in the rear jaw 26, whereas the second closure member 74 is for latching the first attachment pin 122 in the first jaw 22. The hydraulic cylinder 40, hydraulic lines for which are conventional in the art but not shown, is for powering the movement of the first closure member 30, which in this embodiment pivots within the coupler housing 88 around an axle 118 between a latched condition, such as that shown in FIG. 1, in which the first closure member 30 secures the second attachment pin, to a release condition, in which the closure member 30 is pulled away from that second attachment pin to open the rear jaw, as shown in FIGS. 2 and 3. In this embodiment this is achieved by rotating the closure member 30 in a direction such that the bottom part moves towards the front of the coupler 10.

The coupler also includes a pivot pin 98 for the second closure member 74 for pivotally mounting the second closure member 74 above and in front of the seating position for the first attachment pin 122. The second closure member thus likewise has a fixed axis relative to the coupler housing 88.

A piston pin 102 is also provided, extending between opposing side walls of the coupler, generally parallel to the two attachment pins 122, 134, for pivotally mounting a distal end of the piston 104 of the hydraulic cylinder 40 in the coupler housing 88. The head 112 of the cylinder 40 is then pivotally attached to the first closure member 30 by one or more pins 114, whereupon the hydraulic cylinder can move the first closure member—in this case a latching hook. In an alternative embodiment, the cylinder and piston may be reversed so that the head 112 of the cylinder 40 is fixed to the housing 88 and the distal end of the piston 104 is instead mounted on the first closure member 30.

The actuator, and in this example the cylinder 40, has a front latch actuating member (a "release member 36" extending in a forward direction therefrom. That release member 36 is provided for interaction with the second closure member 74—in this embodiment indirectly. In this embodiment, this is achieved by the free end of the release member 36 engaging a release arm 152 of a front latch control component, which in turn interacts with the second closure member 74. For this purpose there is a flange 80 provided on the second closure member 74, which flange has a release surface 82 that can be contacted by the release arm 152 when the second closure member is in any position between a default latching position, as per FIG. 1, and an open condition, as per FIG. 2, continual movement of the release member 36 in a forward direction 38 relative to the housing 88, after contact with the release arm 152, causing such contact between the release arm 152 and the release surface 82 to occur and then a resultant movement of the second closure member 74 from its default latching position to the open condition due to the bias of the release arm 152 on the release surface of the second closure member 74.

The second closure member can also move from the default latching position of FIG. 1 in an opposite direction towards a more closed condition, as per FIG. 3. In that more closed condition, where the free end at the bottom thereof moves forwards, the release surface 82 moves into a position beyond the reach of the release arm 152 (wherein below its line of movement), whereby the release arm 152 can no longer interact with the release surface 82 of the flange to move the second closure member 74 to the open condition. Instead, upon the continued movement of the release member 36 into the position in which it would have opened the second closure member 74, the release arm 152 now instead puts its end at a position that lies over the flange 80, the reverse side 136 of which flange being now a latch retention surface 136. The release member 36 thus instead moves the release arm 152 into a condition in which it locks the second closure member 74 in a position below the open condition, such as its default latching or more closed condition—the release arm will be prevented from rotating or moving further upwards, thus providing the locking function, either by a stop on the housing, or as shown by a second arm 52 on the pivotal component 50 that has the release arm 152 that instead would be stopped from such further rotation.

In order to default the second closure member 74 into its default latching position, it is provided with a spring to provide a biasing force there into. This will be a bi-directional spring to allow the bi-directional movements of the second closure member—to either the more latched condition or the open condition.

In this embodiment the second closure member is pivotally mounted about its axle 98. The spring biases the second closure member 74 such that it defaults under the forces of the spring into the default latching position in which it partially extends across the mouth 58 of the front jaw 22. The spring in this preferred embodiment is a Rosta-type spring. However a conventional coil spring could likewise be provided to serve that purpose, for example by being connected to the housing at one end and to a flange of the second closure member 74 at the other. The Rosta-type spring, however, provides a compact solution. It will be described in greater detail below with reference to FIGS. 12 to 16.

A free end 32 of the second closure member 74 is arranged so that should the first attachment pin 122 be attempted to be removed from its seat at the back 34 of the front jaw 22, it will eventually engage the second closure member, upon which the second closure member 74 will tend to be rotated into (or towards) the more closed condition of FIG. 3.

As known in the art, the second closure member may have flanges or surfaces thereon which interact with stop surfaces 46 on the coupler housing 88 to restrict rotational movement of this second closure member 74 so that it will allow degrees of rotation of perhaps no more than 40 to 90°. In this embodiment it is about 60° between fully blocking and fully open—fully open bringing the lowest edge of the second closure member substantially parallel to the upper wall 42 of the front jaw, and the more closed condition having that surface instead at about 60° from that upper wall 42. Its default rest position, however, may be a chosen angle between 20° and 50° from the fully open position. As shown, it is about 30 degrees. As for the more closed position, this might be between 30 and 70 degrees.

As shown in FIGS. 1 to 3, the second closure member is provided with a curved free end surface 32, which surface is engaged by the first attachment pin 122 when the second closure member 74 is being moved from its default position into the more closed position. That curved surface can serve to reduce or remove the requirement of one of the stops 46—by partially cupping the attachment pin, a condition can be achieved where there is a two-point contact between the attachment pin and the free end surface 32, or such that the cup starts to jam against the attachment pin as the cup provides a varying interface angle with the pin. In that jammed condition, further downward rotation of the second closure member 74 would be prevented. This would generally occur if the coupler and accessory was inverted such that the pin sits against and is loaded upon the upper wall 42 of the front jaw. That thus provides a secure blocking of the exit of the first attachment pin 122 out of the front jaw.

In FIG. 3, however, the coupler is not inverted and thus the first attachment pin 122 sits on a lower part of the front jaw 22. In that lower part, this embodiment has a recess 48, sized to accommodate a part of the attachment pin 122—preferably with at least a two-point contact. This recess terminates at or before a lip 126 near the free end of that lower part of the jaw 22. This recess and lip will work with the second closure member's free end 32 to contain the first attachment pin within the recess because the cupped portion pushes the pin 122 down into that recess 124 if the first pin continues to press against the closure member and the lip.

The cupped portion 128 pushing that attachment pin 122 into the recess 124 is shown in FIG. 3. With this arrangement, the pin 122 cannot exit the front jaw 22, and the lip caries much of the force from the pin.

In addition to the cupped portion 128, the second closure member 74 comprises a body for housing the axle 98 and the Rosta-type spring as discussed below, with the body featuring the first flange for providing the release surface 82 and a second flange for providing a latching bar of the front jaw. In this embodiment the latching bar extends generally radially from the body with respect to the axle 98. The first flange 80 likewise extends generally radially from that body. Between them they provide a groove or recess 84 therebetween. In use, the release arm 152 will enter into that groove or recess 84 when lifting the second closure member 74 into the open condition as shown in FIG. 2, but will fall out of that groove or recess 84 when the cylinder 40 extends its piston 104 to move the first closure member rearwardly. It thus can then instead pass over the original flange 80 when the latching bar is instead first moved by the first attachment pin of the accessory into its more closed condition. As the release arm 152 passes over the original flange 80, the release arm moves into a position over the top of that original flange 80 for instead selectively engaging with the latch retention surface on the reverse side 136 of the original flange 80 in the event that the second closure member 74 was attempted to be re-opened again, until such a time that the actuator once again re-extends the piston 104 out from the cylinder 40 (which then returns the release arm 152 to a position rearward of that original flange 80.

As for the cupped portion 128, it is formed by a rearward edge of a further flange 84, extending at the sides of, but between, the original flange 80, with the release surface, and the second flange with a latching bar and free end 32.

As for the actuating member 36 on the cylinder 40, it comprises a forward facing finger. To the side of that finger is a protrusion 86, which protrusion 86 has a forward face that contacts the release arm 52. This allows the release arm 152 to be spaced to the side of the cylinder 40, as the protrusion extends sideways too.

In this embodiment the release arm 152 is part of a pivotal component 50, which pivotal component 50 is mounted on the same axis as the piston pin 102. For this purpose, the same axle pin 102 may be used. The pivotal component 50 has the release arm 152 extending substantially radially outward therefrom and has circumferentially spaced therefrom a second arm 52. Between the release arm 52 and the second arm 52 is a further recess or groove within which the protrusion 86 will fit during engagement of the release arm 152 with the release surface 82 and during positioning of the release arm 152 above the first flange 80, as shown in FIG. 3. Upon extension of the piston 104 out of the cylinder 40, however, the protrusion 86 exits that further groove or recess, thus allowing free rotation of the pivotal component 50.

That pivotal component 50 could alternatively be sprung biased into a default condition with the release arm 152 positioned out of the groove or recess 84 of the second closure member, which in this embodiment is a downwardly hanging position.

Preferably the release arm 152 has a lip for engaging the release surface.

The second arm, by being behind the protrusion 86 when the protrusion is engaging the release arm 152, will serve to prevent over rotation of the pivotal component 50 upon inversion of the coupler, or during opening of the second closure member when the release arm has been moved to the position above the second closure member by the actuating member 36 or protrusion 84.

Referring next to FIG. 3, the front attachment pin 122 has moved forwards from the back 34 of the front jaw 22. Further, the piston 104 has retracted further into the cylinder, whereby the latching hook 30 has released the rear attachment pin. In this situation the accessory is still secured onto the coupler by the front jaw, whereby it won't fall off the coupler. As this situation is undesirable, FIGS. 4 to 11 illustrate further optional features of this coupler designed to avoid this situation. They are discussed further below.

In the coupler of FIGS. 1 to 3, the maximum retraction of the piston 104 into the cylinder 40 pulls the first closure member clear of the rear jaw 26, as shown in FIG. 2. Alternative embodiments may only allow it to pull less far, perhaps with the length of the piston or cylinder being longer, or the coupler shorter. In preferred embodiments, the front jaw's latching mechanism still functions as described. In such embodiments, the first closure member will still partially close the opening of the rear jaw even when fully retracted. However, it should pull far enough forwards to release the second attachment pin of any accessory intended to be used with the coupler. Such an arrangement is typically compatible with fewer accessories.

Referring next to FIGS. 13 to 16, the Rosta-type spring is further described.

Figure 16:
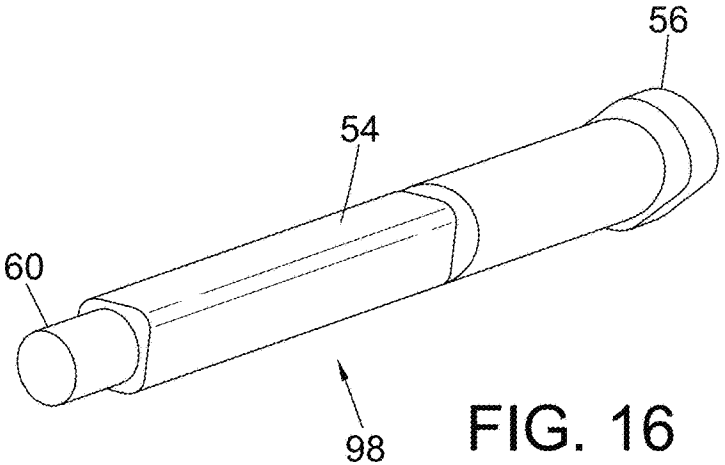
FIG. 16 shows an example centre pin for the Rosta type spring of the coupler.
Figure 12:
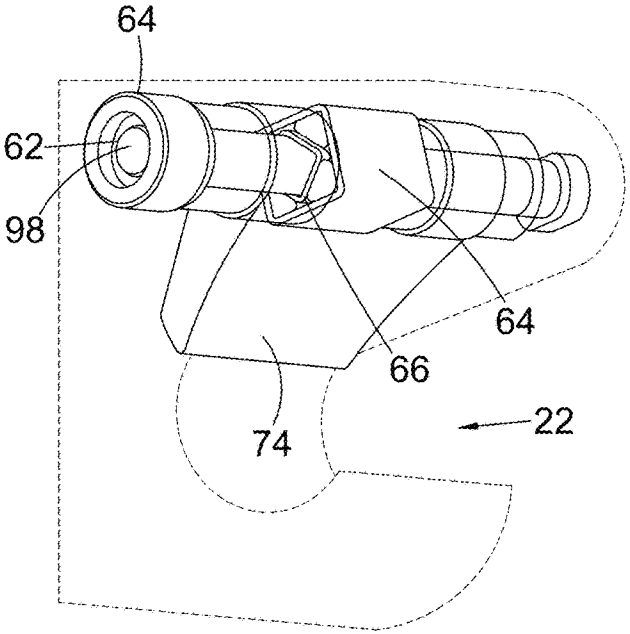
FIG. 12 shows a detail of a preferred form for the spring member of a latch of the front jaw of the coupler—a Rosta-type spring.

The axle 98 of the second closure member is provided with a square section 54 along a part of its length. As shown in FIG. 16, this is a part that is distal of a flanged end 56. Proximal of the square section, i.e. closer to the flanged end, is a round section having a diameter approximately equal to the diagonal length of the square section 54, which round section ends at the flanged end.

The flanged end has flattened side portions such that it can be turned with a tool. It will fit in a recess in the sidewall of the coupler, or in a bushing there within, such that the pin will rotate relative to the housing.

The distal end 60 of the axle 98 is instead provided with a stub with a circular diameter smaller than the square width of the square section 54 so that the axle 98 can be inserted through the rest of the Rosta spring components with the square section 54 being an operable part within the Rosta spring, as discussed below. The distal end 60 will pass through the other side of the housing such that the axle extends through both sides of the housing.

The distal end 60 has a groove near its free end for a circlip for holding the axle at the other side of the housing—shown here within a bushing 64. The axle is this fixed between the two sides of the housing 88.

Mounted upon the square section is the second closure member 74, with a bifurcated body form, from which the flange 80 and the latching arm with the free end 32 extend. They two ends of the bifurcated body form respectively have a round hole at one end and a square hole at the other, such that the round hole sits on the round section part of the axle, proximal to the square section of the axle, and the square section on the square section of the axle. The axles is thus rotatably fixed to the body form.

Between the two ends, however, is a square outer frame 64 and a square inner frame 66 of the Rosta-type spring. Between the two frames are four rubber inserts 68, each one in a respective corner of the outer frame 64.

The outer frame is rotated 45° relative to the inner frame such that the corner gaps internal of the outer frame and external of the inner frame can be mostly filled with the rubber inserts 68. The rubber inserts 68, by being in the corner gaps between the frames, then compress against the flat sides of the inner square frame and against the corner or two side intersecting walls of the outer frame to provide a default 45° position for the inner frame relative to the outer frame. That in turn provides the required default latching condition for the second latching member as the inner square frame is a tight fit on the square section of the axle.

Angles other than 45 may be provided by having differently shaped rubber inserts.

Due to the non-infinite compressibility of the inserts, the Rosta-type spring will allow rotations, without breaking the Rosta-type spring, or angles up to perhaps between 20-38 degrees either side of the default position. Preferably the range of movements is up to 30 degrees either side of centre.

Instead of 30°, other angles are possible, dependent upon the amount of tortion desired to open the jaw—the deformable members provide additional resistance to torque, the more the inside rotates relative to the outside.

The provision of the inner frame is non essential as the axle can instead provide that function directly. However, assembly is easier when the Rosta-type spring is preformed with the inner and outer frames with the square hole in the inner frame for receiving the axle.

To hold the square outer frame in a fixed orientation relative to the coupler's housing 88, that square frame 64 will be located in a recess of the housing 88, or otherwise fixed thereto.

Figure 15:
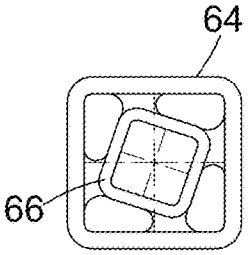
FIGS. 13 to 15 illustrate the operation of a Rosta type spring.
Figure 14:
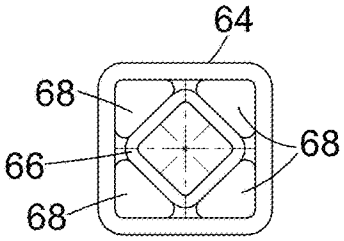
Figure 13:
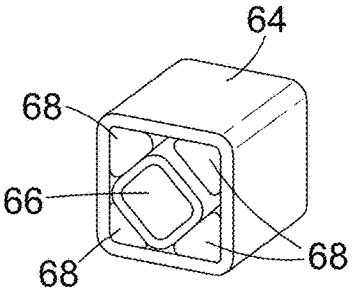

The structure of the Rosta-type spring allows a certain degree of rotation of the inner frame relative to the outer frame—typically up to 30° either way by compressing the rubber elements, as shown in FIG. 15. The second latching member 74 can thus rotate through the illustrated 30 degrees either way.

Instead of the outer frame being a square tube, it could be formed as three sides attached to a flat face of housing 88.

As illustrated, the Rosta-type arrangement of the bi-directional spring allows rotation of the inner square frame relative to the outer square frame by compression and shearing of the rubber elements, which compression and shearing creates a return biasing force to return the square section to its original or default condition. In the present invention, this original condition is the default latching condition as shown in FIG. 1.

Referring next to FIGS. 4 to 11, various methods of providing a bias for the cylinder/piston is shown—arranged to bias the piston into an extended position relative to the cylinder.

Figure 4:
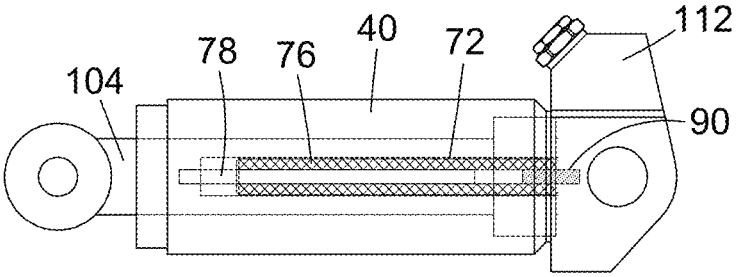
FIGS. 4 and 5 show a hydraulic cylinder for a coupler according to a further aspect of the present invention.
Figure 5:
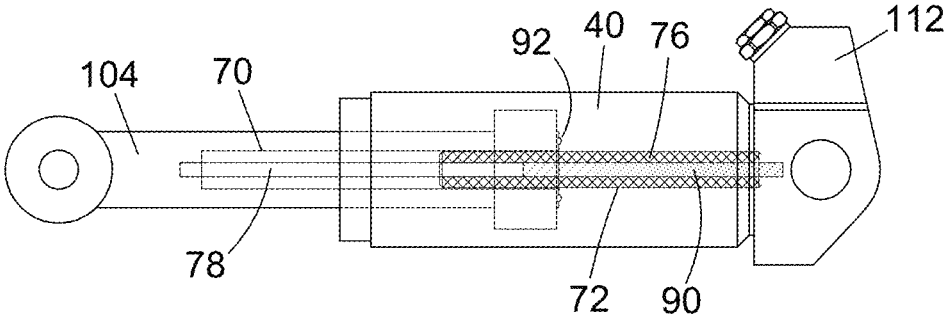

In FIGS. 4 to 9, a sprung driver or biasing mechanism is provided internal of the piston 104. Various solutions for that are illustrated. A first solution is shown in FIGS. 4 and 5, wherein a pneumatic back-up piston is provided internal of the actuator's piston 104, wherein the end of the actuator's piston 104 that is internal of the cylinder has a bore 70 drilled therein for receiving a pneumatic gas spring or piston 72. The pneumatic gas spring or piston comprises a casing 76 and a rod 78, which rod 78 can extend between an extended condition as shown in FIG. 5 and a contracted condition as shown in FIG. 4.

Although a pneumatic piston is illustrated, other forms of sprung driver or biasing mechanism can be used, such as a coil spring, or a compressive material spring, such as a rubber spring. Preferably it achieves a return force upon compression of the component or material device shape within it, be that a coil spring or a compressive gas, fluid or solid. Preferred is a pneumatic piston with the movable rod.

In the contracted condition of FIG. 4, the rod 78 has been contracted into the void 90 as shown in black in FIGS. 4 and 5, thus compressing the gas therein and creating a biasing force to counter the compression of the piston 104 into the cylinder 40.

In this embodiment, to allow for a shorter gas spring 72, the void 90 extends into the head 112 of the cylinder 40.

The void 90 contains air or gas under pressure to provide the pneumatic spring force. As such, the contracted condition of FIG. 4 has a higher pressure at the void 90 than the expanded condition of FIG. 5. Likewise the free-space in the bore, between the rod 78 and the walls of the bore can contain air or gas under pressure, also with the compression being higher when the rod is contracted into the casing 76. FIG. 5 is thus the default condition for the rod 78, whereby the actuator is biased by the gas spring to default to an extended condition, i.e. with the piston 104 extended out of the cylinder 40, thus helping to prevent release of an accessory in the event of a failure of the cylinder 40 as the extended condition locks the attachment pins of the accessory in the jaws of the coupler.

In this first embodiment, the casing 76 is attached to the head 112 of the cylinder 40. Therefore, it will slide within the bore 70 of the piston 104. A seal 92 is provided at the distal end of the piston 104 to seal between the casing 76 and the bore 70 of the piston 104. This prevents the hydraulic fluid of the cylinder 40 entering the space between the casing 76 and the piston 104, during normal use of the actuator. It also prevents that hydraulic fluid entering the free space between rod 78 and the bore 70. This avoids a locking out of the gas spring (as hydraulic fluid is non-compressible). Likewise it prevents the air or gas in the free space of the bore, around the rod, from entering the hydraulic fluid, thus preventing softening of the hydraulic forces of the actuator (as entrained air in hydraulic fluid makes the hydraulic fluid part-compressible).

Figure 6:
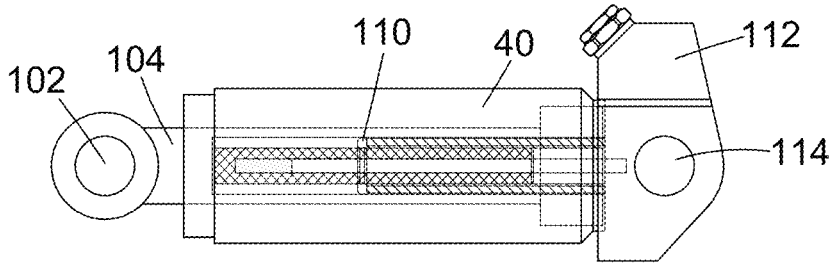
FIGS. 6 and 7 show a different hydraulic cylinder for a coupler according to the further aspect of the present invention.
Figure 7:
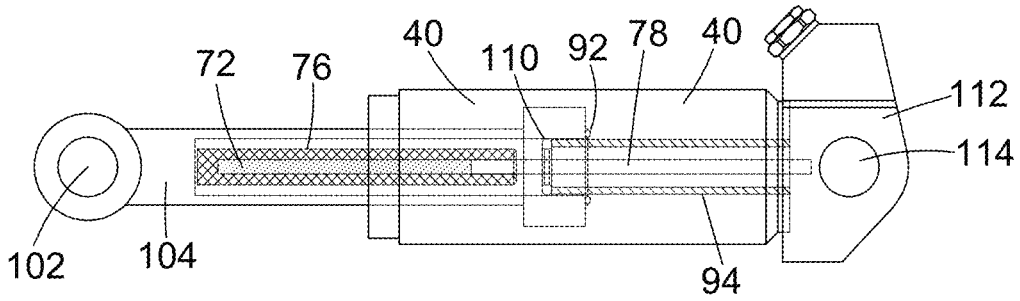

Referring next to FIGS. 6 and 7, an alternative arrangement is provided, albeit with similar benefits. In this second version, the pneumatic gas spring is reversed such that the casing 76 is instead mounted in the bore of the piston 104 and the rod 78 is instead attached to the head 112 of the cylinder 40. With this arrangement, a protective sleeve 94 is provided, into which the casing 76 can slide as the rod 78 contracts into the casing 76, as shown in FIG. 6. A seal is again provided at the end face of the piston 104 to prevent hydraulic fluid from entering the bore, and the air or gas of the bore from entering the hydraulic fluid. However, a further seal 110 is provided at the end of the protective sleeve 94 for sealing against the casing 76. This allows the space around the casing to switch between a single free space and two closed spaces, and it further provides support for the casing as the rod compresses into the casing, thus resisting buckling of the rod/casing.

In an alternative arrangement, the protective sleeve 94 is made longer such that the casing 76 is always nosed into the protective sleeve 94, such that the space around the casing is always separate to the space around the rod.

A benefit from the provision of the protective sleeves 94 is that there is an additional radius to the gas spring arrangement, whereby the protective sleeve provides additional bending stiffness, and thus buckle resistance to the gas spring. Previously the rod could be subject to buckling, especially where it enters the casing.

Figure 8:
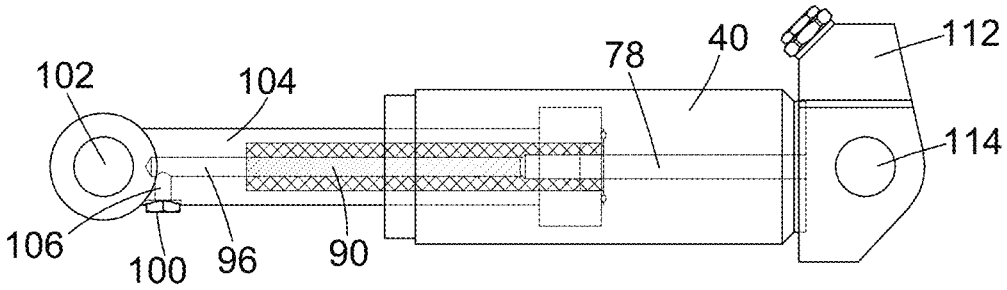
FIGS. 8 and 9 show another different hydraulic cylinder for a coupler according to the further aspect of the present invention.
Figure 9:
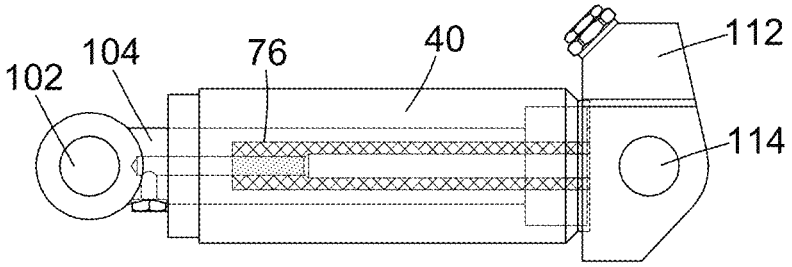

Referring then to FIGS. 8 and 9, a third integrated gas spring is illustrated wherein the casing 76 is again internal to the piston 104. However, the rod is instead wider, and the protective sleeve is not present. Yet further, the rod 78 now terminates against the head of the cylinder, rather than being attached into it.

Rather than providing a casing 76 in a bore of the piston, as shown, it would instead be possible to have the rod in a bore of the piston, whereby the piston itself provides the function of the casing. The casing would thus effectively be defunct, or considered integrated with the piston.

In this third illustrated embodiment, the pressurised void 90 is connected with a tube 96 near the pivotally mounted end of the piston 104, with a threaded stop or cork 100 closing a side vent 106 for that tube 96. With this arrangement, the pressure of the air or gas in the pressurised void 90 can be re-compressed or recharged in the event of pressure loss. It can also be flushed if needed.

Such a recharge port could likewise be provided for the embodiment of FIGS. 6 and 7.

The head could likewise comprise a recharging vent for accessing the void 90 in the embodiment of FIGS. 4 and 5.

Figure 10:
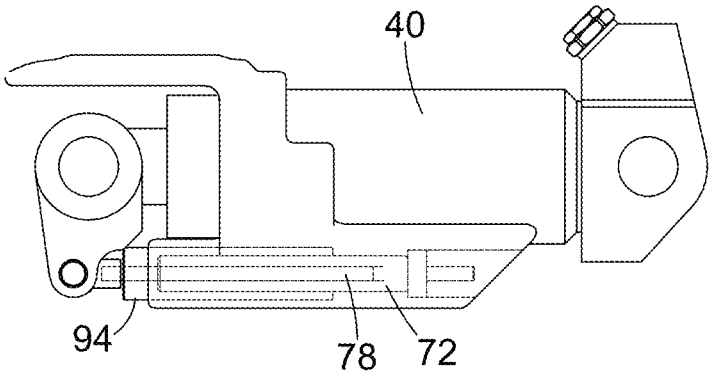
FIGS. 10 and 11 show an alternative arrangement for a hydraulic cylinder for a coupler according to a third aspect of the present invention.
Figure 11:
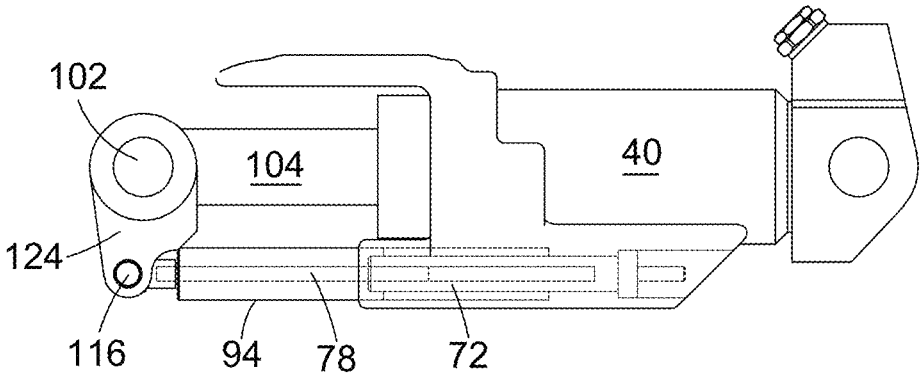

Referring finally to FIGS. 10 and 11, an alternative arrangement is shown wherein the gas spring is instead mounted external and to a side of the cylinder 40, in a side structure 120. The side structure can be specifically for the gas spring, or it can be part of a moulding around the cylinder from which the actuating member 36 extends.

The side structure 120 has a cavity therein containing the gas spring as shown. There is again a protective sleeve 94, but this time it is merely to provide protection for the rod 78 as by being external of the piston, it would otherwise be subject to exposure of the working environment of the coupler. It is no longer exposed to the hydraulics in the cylinder.

In this arrangement, the gas spring 72 can operate to drive the rod 78 and the protective sleeve 94 between a contracted position of FIG. 10 and an extended position of FIG. 11, the extended configuration being the default configuration.

The end of the rod or protective sleeve 94 can be attached to a further flange 124 extending radially from the piston pin 102, which further flange 124 can have a pivotal connection 116 to the rod 78 or protective sleeve 94. By being pivotal, the rod can rotate with the piston as the pivotal latching hook moves. Alternatively the further flange will rotate relative to the piston pin 102. For a sliding latch, the connection might instead be fixed, rather than pivotal, as the actuator would not have a need to pivot.

Usually the external gas spring will be located below the cylinder. This has two benefits. Firstly, as space is limited to the sides of the cylinder, putting it below the cylinder does not further fill the side spaces. Secondly, by being below the cylinder, it will not be as exposed to the external elements during use of an accessory (once an accessory is attached to the coupler) as the accessory will close the bottom of the coupler.

With these gas sprung mechanisms inside or outside the piston of the cylinder 40, the cylinder 40 and the piston 104 will default into a condition such that the first latching hook is in a latching condition in the event of a failure of the hydraulics system of the cylinder 40, or the cylinder itself, albeit not with the usual retention force of the hydraulics. Nevertheless, it will allow an operator to maintain safe retention of an accessory, after noticing a relaxation of the securement of the accessory, for long enough for him to lower the accessory to the floor.

The present invention therefore enables an accessory attached to the coupler to be releasable only by following a proper procedure, as per FIG. 2—it cannot be released from the coupler in the event of an improper use of the coupler.

These and other features of the present invention have been described above purely by way of example. Modifications in detail may be made to the invention within the scope of the claims appended hereto.

The invention claimed is:

1. An excavator coupler comprising:

a housing with a top part for attachment to an excavator arm of an excavator, and a bottom part for attachment to an accessory for the excavator, such as an excavator bucket, the bottom part comprising a front jaw open to a front of the coupler for receiving a first attachment pin of an accessory and a rear pin receiving area open to a bottom of the coupler for receiving a second attachment pin of the accessory;

the coupler further comprising:

a first closure mechanism for the rear pin receiving area, the first closure mechanism comprising an actuator and a movable second pin engaging surface for selectively securing the second attachment pin in the rear pin receiving area and for pulling the first attachment pin into the front jaw of the coupler;

an axle pin defining an axis, the axle pin extending between opposing side walls of the coupler, generally parallel to the first and second attachment pins, for pivotally mounting a distal end of the actuator in the housing on the axis;

a second closure member for the front jaw for selectively retaining the first attachment pin in the front jaw; and a front latch control component for selectively controlling the second closure member between an open state and a closed state, the front latch control component being a pivotal component mounted on the axis;

wherein the actuator comprises a release member for selectively engaging a release arm on the front latch control component to activate or deactivate the front latch control component; and the second closure member has a more closed condition wherein a release surface of the second closure member moves into a position beyond the reach of the release arm.

2. The coupler of claim 1, wherein the rear pin receiving area is a rear jaw that is open to a bottom of the coupler.

3. The coupler of claim 1, wherein a bottom wall of the front jaw comprises a lip at its free end.

4. The coupler of claim 1, wherein the rear pin receiving area comprises a lip at its free end.

5. The coupler of claim 1, wherein the rear pin receiving area comprises an angled slope leading towards the free end thereof to force the second attachment pin into engagement with the rear pin receiving area when the two attachment pins are clamped onto the coupler by the actuator.

6. The coupler of claim 1, wherein the actuator is a hydraulic ram with a cylinder and piston.

7. The coupler of claim 1, wherein the movable second pin engaging surface is part of a pivoting hook.

8. The coupler of claim 1, wherein the second closure member is pivotally mounted to the housing.

9. The coupler of claim 1, wherein the second closure member is pivotally mounted in the housing to rotate about an axis that is positioned above and in front of a back wall of the front jaw.

10. The coupler of claim 1, wherein the second closure member is sprung into a default latching position.

11. The coupler of claim 1, wherein when the second closure member is in the more closed condition, the release arm has an end that is located above the second closure member when the release arm is fully engaged by the release member, in which position the release arm prevents opening of the second closure member.

12. The coupler of claim 1, wherein the second closure member is biased into a default latching position by a bi-directional spring that allows bi-directional movements of the second closure member.

13. The coupler of claim 12, wherein the spring is a type of spring with an inner bar, an outer casing, each with square sections, and elastic members in the corners of the outer casing.

14. An excavator coupler according to claim 1, wherein the second closure member comprises a hub that is mounted for axial rotation about its axis, the hub having a spring to center it in a default locking position in which a locking arm of the second closure member at least partially extends across a mouth of the front jaw, the spring having an inner bar, an outer casing, each with square sections, and elastic members in the corners of the outer casing.

15. The coupler of claim 14, wherein an axle of the second closure member is rotationally fixed relative to the second closure member, and it forms the inner bar of the spring, the outer casing of the spring being rotationally fixed relative to the housing of the coupler.

16. The coupler of claim 14, wherein the outer casing of the spring is rotationally fixed relative to the second closure member, and an axle of the second closure member is rotationally fixed relative to the housing of the coupler.

17. The coupler of claim 14, wherein the outer casing is a single piece construction.

* * * * *